United States Patent [19]

Holgado

[11] 4,010,105

[45] Mar. 1, 1977

[54] OIL-IN-WATER EMULSION HYDRAULIC FLUID

[75] Inventor: Rosauro V. Holgado, Philadelphia, Pa.

[73] Assignee: E. F. Houghton and Company, Norristown, Pa.

[22] Filed: Apr. 21, 1975

[21] Appl. No.: 569,661

[52] U.S. Cl. ..... 252/77; 252/312

[51] Int. Cl.[2] ..... C10M 1/06; C10M 1/32

[58] Field of Search ..... 252/75, 77, 49.5, 312

[56] References Cited

UNITED STATES PATENTS

| | | | |
|---|---|---|---|
| 2,892,854 | 6/1959 | Hommer | 252/77 X |
| 2,967,831 | 1/1961 | Hommer | 252/77 |
| 3,105,050 | 9/1963 | Fischer | 252/77 X |

FOREIGN PATENTS OR APPLICATIONS

| | | |
|---|---|---|
| 1,109,330 | 4/1968 | United Kingdom |

*Primary Examiner*—Harris A. Pitlick
*Attorney, Agent, or Firm*—Howson and Howson

[57] ABSTRACT

A stable, fire resistant hydraulic fluid of the oil-in-water emulsion type having the property of relatively uniform viscosity over a broad range of water contents in which the non-polar (oil) and polar (water) components are coupled by means of a combination of an emulsifier, and a mixture of a relatively high molecular weight polyglycol or alkyl substituted polyglycol and a relatively low molecular weight glycol.

6 Claims, No Drawings

OIL-IN-WATER EMULSION HYDRAULIC FLUID

DESCRIPTION OF THE INVENTION

Hydraulic fluids are used in a host of devices and systems for the transmission of mechanical energy by fluid pressure. Hydraulic fluids find use in varied environments and must have a wide range of physical properties to be acceptable in many different kinds of apparatus.

It is known that hydraulic fluids of the oil-in-water emulsion type are especially desirable in many applications because of their fire resistance. Some of such hydraulic fluids have contained a water soluble low molecular weight polyhydric alcohol as a freezing point depressant to render the hydraulic fluid useful over a wide temperature range, thereby eliminating the need for special handling or storage facilities to prevent breakdown of the emulsion due to freezing of the continuous aqueous phase. Typical hydraulic fluids of this type are described in U.S. Pat. Nos. 2,892,854 and 2,967,831.

Acceptance of oil-in-water emulsion type hydraulic fluids has not been as great as might be expected due to certain inherent disadvantages thereof. Conventional oil-in-water emulsions do not have sufficient viscosity to be widely applicable as all-purpose hydraulic media. Viscosity can be increased by increasing the concentration of the oil component, but the viscosity of such oil-in-water emulsion type fluids has been found to undergo considerable alteration by relatively small changes in water content. Since the fluids can lose water by evaporation during use, viscosity changes which cannot be tolerated may result. Oil-in-water emulsion type hydraulic fluids also tend to be less effective in providing necessary lubrication, especially in high pressure operations, than the more conventional water-in-oil emulsion type hydraulic fluids because of their lower viscosity and the fact that they contain less oil. A further necessary quality of emulsion type hydraulic fluids is that they be stable, that is, remain in an emulsified state, over a wide temperature range. Unfortunately, oil-in-water emulsion type hydraulic fluids have been somewhat deficient in this property.

In summary, to be acceptable as a hydraulic fluid, oil-in-water emulsion type hydraulic fluids should possess the following qualities: (a) be stable, that is, remain in an emulsified state, over a wide range of temperatures; (b) have a viscosity range which provides adequate lubrication for mechanical components; (c) provide effective boundry lubrication; (d) have viscosity stability when subjected to high shear; (e) vary little in viscosity with changes in water content; (f) be compatible with petroleum base fluids, and (g) be capable of operating in existing hydraulic equipment. It is the object of this invention to provide a hydraulic fluid of the oil-in-water emulsion type which satisfies the criteria described above.

According to this invention there is provided a fire resistant hydraulic fluid of the oil-in-water emulsion type having the property of relatively uniform viscosity over a broad range of water contents comprising (1) from about 5 to about 15% by weight of an emulsifier which is the condensation product of a dialkanol amine, having from 2 to 4 carbon atoms in the alkanol chains, with a fatty acid chosen from the group consisting of aliphatic monocarboxylic acids having from 16 to 22 carbon atoms in the aliphatic chains, and reactive esters and halides thereof, said dialkanol amine being present in an amount between about 0.75 and 1.25 equivalents per equivalent of acid; (2) from about 10 to about 30% by weight of a mineral oil (3) from about 5 to about 15% of a water soluble polyglycol selected from the group consisting of polyoxyalkylene glycols and their lower monoalkyl derivatives having a molecular weight of at least about 400; (4) from about 10 to about 25% of a glycol selected from the group consisting of mono- and diethylene and propylene glycols, and (5) from about 30 to about 50% water.

Preferably the hydraulic fluid of this invention comprises (1) from about 10 to about 13% of emulsifier; (2) from about 23 to about 28% mineral oil; (3) from about 7 to about 12% of polyglycol; (4) from about 12 to about 18% glycol, and (5) from about 37 to about 43% water.

In one of the particularly preferred hydraulic fluids of this invention (1) the emulsifier is the condensation product of substantially molar equivalents of oleic acid and diethanol amine; (2) the mineral oil is a naphthenic oil having a viscosity of about 100 SUS at 100° F.; (3) the polyglycol is the butyl ether of poly (oxyethylene-oxy-1,2-propylene) glycol having an average molecular weight of about 1500, and (4) the glycol is dipropylene glycol.

In another preferred hydraulic fluid of this invention, (1) the emulsifier is a condensation product of substantially molar equivalents of oleic acid and diethanol amine; (2) the mineral oil is a naphthenic oil having a viscosity of about 200 SUS at 100° F.; (3) the polyglycol is polypropylene glycol having an average molecular weight of 400; and (4) the glycol is ethylene glycol.

It was discovered that by inclusion in the oil-in-water emulsion type hydraulic fluid of this invention of a water soluble polyglycol having a molecular weight of at least 400, the water content of the fluid can be varied over a relatively broad range, e.g. from about 30 to about 50% by weight of the composition, with only relatively small, tolerable changes in viscosity. Thus, should a hydraulic fluid of this invention containing on the order of 50% water in use undergo a reduction in water content to about 30%, nevertheless, the viscosity of the fluid is not so altered as to require replacement of the fluid. Similarly water build up in the fluid due to condensation or other causes can be tolerated, provided the water content does not significantly exceed 50%. In addition, the hydraulic fluid of this invention can be used in vane pumps operated under high pressure, whereas similar prior known oil-in-water emulsion type hydraulic fluids have failed to perform satisfactorily under such conditions.

The emulsifier used in the hydraulic fluid of this invention comprises an amine-fatty acid condensate which may be produced by reacting a fatty acid, fatty acid ester or halide and a dialkanol amine at temperatures ranging from about 120° C. to about 170° C. for a period sufficient to reduce the free amine content of the reaction mixture to below about 5%, preferably 3%, by weight. This is equivalent to a free fatty acidity (FFA) value, calculated as oleic acid, of less than about 6.5%. Such condensates are fully disclosed in U.S. Reissue Patent 21,530 to Kritchevsky. The fatty acids which are preferably used are those saturated and unsaturated aliphatic monocarboxylic acids having from about 16 to about 22 carbon atoms in the aliphatic chain and reactive esters and halides thereof. These acids may be conveniently obtained from various animal and vegetable fats. Specific examples of suitable monocarboxylic saturated fatty acids are palmitic, stearic, and behenic acids. Suitable unsaturated fatty acids are monoethenoid acids, such as palmitoleic and oleic acids; diethenoid acids, such as linoleic acid; and triethenoid acids, such as linolenic acid. From a commercial standpoint mixtures of fatty acids derived from tallow, tall oil, soybean oil, rapeseed oil, and cottonseed oil have been found to be particularly suitable for the practice of this invention. The amine used in forming the condensate may be selected from those amines having at least one unsubstituted basic hydrogen atom attached to a nitrogen atom. Specific examples are dialkanol amines having from 2 to 4 carbon atoms in each alkanol chain. Specific examples of amines that may be used are diethanol and diisopropanol amine. The condensate obtained from the above outlined procedure is believed to contain a mixture of amide, salt, and possibly ester type fatty acid derivatives, as well as a small amount of free amine which should not exceed about 10% by weight of the final reaction product.

The dialkanol amine should be present in an amount between about 0.75 and about 1.25 equivalents per equivalent of acid.

A particularly preferred emulsifier comprises the condensation product of substantially molar equivalents of oleic acid and diethanol amine.

The emulsifier should comprise from about 5 to 15% by weight, preferably from about 10 to about 13% of the hydraulic fluid.

To make the fluid emulsions of the present invention, an oil-emulsifier base is first prepared by mixing the emulsifier with a suitable mineral oil. The term "mineral oil" as used in this specification and claims refers to refined distillate oils having Saybolt Universal viscosities between about 50 seconds and 700 seconds at 100° F. Although any of the several mineral oils may be used for the purposes of the invention, it is preferred to use a light lubricating oil of the naphthenic type having a Saybolt Universal viscosity between 80 and 200, preferably between about 100 and 200, seconds at 100° F.

The amount of oil used in preparing the base should be such as to provide the final emulsion with an oil content of from about 10 to about 30%, by weight, preferably from about 23 to about 28%. A particularly preferred mineral oil is a naphthenic oil having a viscosity of about 100 SUS at 100° F. Another preferred mineral oil is a naphthenic oil having a viscosity of about 200 SUS at 100° F.

Suitable polyglycols for use in the fluid include water soluble polyoxyalkylene glycols and lower mono-alkyl ethers thereof, having a molecular weight of at least about 400. A particularly preferred polyglycol is the monobutyl ether of poly (oxy-ethy-lene-oxy-1,2-propylene) glycol having an average molecular weight of about 1500. The polyglycol acts as a thickener for the aqueous phase and has a coupling effect to provide a clear emulsion. Another preferred polyglycol is a polypropylene glycol having an average molecular weight of about 425.

As stated above, the hydraulic fluid also contains from about 10 to about 25%, preferably 12 to 18% of a glycol selected from the group consisting of mono- and di- ethylene and propylene glycols. The glycol acts as a freezing point depressant, and in combination with the other components improves the lubricating quality of the hydraulic fluid.

The polyglycol and glycol should first be combined with the base mixture of emulsifier and oil in such proportions as to provide a hydraulic fluid having each of such components present in the above-specified amounts. Water is then added with agitation to provide the final product.

The stable hydraulic fluids of this invention will have viscosities in the range of from about 100 to about 600 SUS at 100° F., and viscosity will vary within this range with water content, polyglycol molecular weight and oil viscosity. For any given composition, viscosity will vary by less than 120 SUS at 100° F. with changes in water content within the range of 30 to 50% water. Preferred hydraulic fluids of this invention have viscosities in the range between about 250 to 350 SUS at 100° F.

In addition to the essential components of which the hydraulic fluid of this invention is composed, there may be present one or more of the various additives heretofore included in hydraulic fluids of the oil-in-water type. Typical of such additives are corrosion inhibitors, antifoam agents, metal passivators, colorants, etc. Generally such additives will be present in amounts not exceeding about 2% by weight.

The following examples illustrate specific embodiments of the present invention and are not to be construed as limiting the scope thereof.

EXAMPLE 1

An equimolar mixture consisting of 765 parts, by weight, of oleic acid and 285 parts by weight of diethanol amine are charged into a reactor equipped with a condenser, agitator and jacket for steam and cooling water. The mixture is heated to 310°–320° F. with agitation by means of steam. Water begins to condense out of the reaction when the temperature of the mixture reaches 290°–300° F.

After 33–42 parts by weight of water condensate is collected, the free fatty acidity (FFA) value calculated as oleic acid of the reaction mixture is determined. The reaction is continued until the FFA value drops to 9.0% as oleic acid. Vacuum of about 5 in. of mercury is applied for about 10 minutes. The vacuum procedure is repeated until the FFA value falls below about 7%. The steam to the jacket is shut off and cooling water is introduced to cool the batch as rapidly as possible to 100°–120° F. The above reaction can be performed without application of vacuum but a longer reaction time is required.

The resulting emulsifier condensate is a clear amber viscous liquid having a FFA value of 4.8 – 6.5% as oleic acid.

EXAMPLE 2

A hydraulic fluid of this invention having the composition set forth in Table I is prepared by the below-described method.

TABLE I

| Constituent | Parts by Weight |
|---|---|
| Emulsifier of Example 1 | 11 |
| Mineral Oil* | 24.5 |
| Polyglycol** | 8 |
| Dipropylene Glycol | 16 |
| Additives*** | 0.5 |
| Water (soft) | 40 |

TABLE I-continued

| Constituent | Parts by Weight |
|---|---|
| | 100 |

*naphthenic mineral oil having a viscosity of about 100 SUS at 100° F.
**butylether of poly (oxyethylene-oxy-1,2-propylene) glycol having an average molecular weight of about 1500.
***corrosion inhibitors, colorants, etc.

The emulsifier, mineral oil, polyglycol, glycol and additives are charged to a clean tank equipped with mixing and heating facilities. Heating of the mixture is begun, and prior to the temperature thereof reaching 120° F., the soft water is added with stirring. The batch is maintained at 110°–120° F. with agitation until a uniform blend is obtained. The batch is then drawn through a 100 mesh strainer into suitable receptacles.

The resulting hydraulic fluid has the properties given in Table II, below.

TABLE II

| | |
|---|---|
| Viscosity at 100° F. SUS | 300 ± 50 |
| pH | 9.2 ± 0.2 |
| Alkalinity Number | 58 ± 8 |
| Cloud Temperature, ° F. | 100 – 120 |
| Specific Gravity at 60° 0.99 | |
| Pour Point, ° F. | −15 |
| Refractive Index at 70° F. | 1.4286 |
| Sugar Refract. Rdg., ° Brix. | 54 ± 2 |
| Corrosion Tests: | |
| Rust Test (ASTM D-665-A) 72 hrs. | Passed |
| Copper Strip (ASTM D-130) | 1 a |
| Falex Test (750 lbs. Load) | |
| Block loss, mgs. | 2.8 |
| Pin loss, mgs. | 5.9 |
| Four-Ball Wear Test | |
| 1) 1730 rpm, 15 kg, 15 mins, r.t. Scar Dia., mm. | 0.47 |
| 2) 1200 rpm, 1 hr., r.t. | |
| 20 kg load: Scar Dia. mm | 0.61 |
| 40 kg load: Scar Dia. mm | 0.68 |

EXAMPLE 3

The hydraulic fluid of Example 2 was subjected to the following pump test:

| Test Conditions | |
|---|---|
| Pump | Vickers V-104-C-10 |
| Pressure | 1250 psi |
| Speed | 1200 rpm |
| Output | 7.5 gpm |
| Sump Temperature | 103° – 107° F. |
| Filter | 25 microns pleated paper |
| Duration | 1008 hrs. |
| **Test Results** | |
| Ring Wear Loss | 128 mgs |
| Vanes Set Wear Loss | 229 mgs |
| Total Wear Loss | 357 mgs |
| Wear Rate | 0.36 mg/hr. |
| **Fluid Properties** | |
| Viscosity at 100° F. | |
| Before Test | 267 SUS |
| After Test | 258 SUS |
| pH | |
| Before Test | 9.1 |
| After Test | 9.0 |
| Alkalinity No. | |
| Before Test | 54 |
| After Test | 60 |

EXAMPLE 4

Another fluid of this invention, having the composition set forth in Table III, is also prepared by the method described in Example 2.

TABLE III

| Constituents | Parts by Weight |
|---|---|
| Emulsifier of Example 1 | 12.0 |
| Mineral Oil* | 24.5 |
| Polyglycol** | 12.0 |
| Ethylene Glycol | 11.0 |
| Soft Water | 40.0 |
| Additives*** | 0.5 |
| | 100.0 |

*naphthenic oil having a viscosity of about 200 SUS at 100° F.
**polypropylene glycol having an average molecular weight of about 425
***corrosion inhibitor, colorants, etc.

The resulting hydraulic fluid has the properties given in Table IV.

TABLE IV

| | |
|---|---|
| Viscosity at 100° F., SUS | 330 ± 50 |
| pH | 9.2 ± 0.2 |
| Alkalinity Number | 60 ± 8 |
| Cloud Temperature, ° F. | 135 ± 6 |
| Specific Gravity at 60° F. | 1.01 |
| Pour Point, ° F. | +5 |
| Refractive Index at 70° F. | 1.4232 |
| Sugar Refract. Rdg., ° Brix. | 52 ± 2 |
| Corrosion Tests: | |
| Rust Test (ASTM D-665-A) 72 hrs. | Passed |
| Copper Strip (ASTM D-130) | 1 a |
| Falex Test (750 lbs. Load) | |
| Block loss, mgs | 0.7 |
| Pin loss, mgs | 0.9 |
| Four-Ball Wear Test | |
| 1) 1730 rpm, 15 kg, 15 min, r.t. Scar Dia., mm. | 0.41 |
| 2) 1200 rpm, 1 hr, r.t. | |
| 20 kg. Load: Scar Dia. mm | 0.57 |
| 40 kg. Load: Load: Dia. mm | 0.66 |

EXAMPLE 5

Hydraulic fluid of Example 4 was also subjected to a pump test using the following conditions:

| Test Conditions | |
|---|---|
| Pump | Vickers V-104 C-10 |
| Pressure | 1000 psi |
| Speed | 1200 rpm |
| Output | 7.5 gpm |
| Sump Temperature | 120° F. |
| Filter | 25 microns pleated paper |
| Duration | 600 hrs. |
| **Test Results** | |
| Ring Wear Loss | 162 mgs |
| Vanes Wear Loss | 280 mgs |
| Total Wear Loss | 442 mgs |
| Wear Rate | 0.74 mg/hr |
| **Fluid Properties** | |
| Viscosity at 100° F. | |
| Before Test | 259 SUS |
| After Test | 257 SUS |
| pH | |
| Before Test | 9.2 |
| After Test | 8.8 |
| Alkalinity No. | |
| Before Test | 51 |
| After Test | 70 |

The test data obtained as a result of carrying out the tests described in Examples 3 and 5 show the suitability of fluids in this invention for high pressure hydraulic operations.

EXAMPLE 6

Hydraulic fluids were prepared as in Examples 2 and 4 except that water contents were varied by 5% increments from 30 to 50% by weight, while maintaining the same ratio of the anhydrous compounds. Test results are tabulated below:

TABLE V

| Percent Water | Fluid Viscosity at 100° F. SUS Example 2 | Example 4 |
|---|---|---|
| 50 | 112 | 138 |
| 45 | 205 | 150 |
| 40 | 326 | 291 |
| 35 | 302 | 270 |
| 30 | 257 | 262 |

The above data show that advantageously the hydraulic fluids of this invention can vary considerably in water content, e.g. from 30% to 50% with tolerable changes in fluid viscosity.

What is claimed is:

1. A fire-resistant hydraulic fluid of the oil-in-water type having the property of relatively uniform viscosity over a broad range of water contents comprising (1) from about 5 to about 15% by weight of an emulsifier which is the condensation product of a dialkanol amine having from 2 to 4 carbon atoms in the alkanol chains, with a fatty acid chosen from the group consisting of aliphatic monocarboxylic acids having from 16 to 22 carbon atoms in the aliphatic chain, and reactive esters and halides thereof; said dialkanol amine being present in an amount between about 0.75 and 1.25 equivalents per equivalent of acid; (2) from about 10 to about 30% by weight of a mineral oil; (3) from about 5 to about 15% of a water soluble polyglycol selected from the group consisting of polyoxyalkylene glycols and their lower monoalkyl derivatives having a molecular wieght of at least about 400; (4) from about 10 to about 25% of glycol selected from the group consisting of mono- and di- ethylene and propylene glycols, and (5) from about 30 to about 50% water, the molecular weight of said polyglycol and the viscosity of said mineral oil being such that the viscosity of said hydraulic fluid is within the range of from about 100 to about 600 SUS at 100° F., and said viscosity varies less than about 120 SUS at 100° F. with changes in water content within said range of from about 30 to about 50% water.

2. The fluid of claim 1 in which (1) said emulsifier is the condensation product of substantially molar equivalents of oleic acid and diethanol amine; (2) said mineral oil is a naphthenic oil having a viscosity of about 100 SUS at 100° F.; (3) said polyglycol is the butyl ether of poly (oxyethyleneoxy-1,2-propylene) glycol having an average molecular weight of about 1500, and (4) said glycol is dipropylene glycol.

3. The fluid of claim 1 in which (1) said emulsifier is the condensation product of substantially molar equivalents of oleic acid and diethanol amine; (2) said mineral oil is a naphthenic oil having a viscosity of about 200 SUS at 100° F.; (3) said polyglycol is polypropylene glycol having an average molecular weight of about 450, and (4) said glycol is ethylene glycol.

4. A fire-resistant hydraulic fluid of the oil-in-water type having the property of relatively uniform viscosity over a broad range of water contents comprising (1) from about 10% to about 13% by weight of an emulsifier which is the condensation product of a dialkanol amine having from 2 to 4 carbon atoms in the alkanol chains, with a fatty acid chosen from the group consisting of aliphatic monocarboxylic acids having from 16 to 22 carbon atoms in the aliphatic chain, and reactive esters and halides thereof, said dialkanol amine being present in an amount between about 0.75 and 1.25 equivalents per equivalent of acid; (2) from about 23 to about 28% by weight of a mineral oil; (3) from about 7 to about 12% of a water soluble polyglycol selected from the group consisting of polyoxyalkylene glycols and their lower monoalkyl derivatives having a molecular weight of at least about 400; (4) from about 12 to about 18% of glycol selected from the group consisting of mono- and di- ethylene and propylene glycols, and (5) from about 30 to about 50% water, the molecular weight of said polyglycol and the viscosity of said mineral oil being such that the viscosity of said hydraulic fluid is within the range of from about 100 to about 600 SUS at 100° F., and said viscosity varies less than about 120 SUS at 100° F. with changes in water content within said range of from about 30 to about 50% water.

5. The fluid of claim 4 in which (1) said emulsifier is the condensation product of substantially molar equivalents of oleic acid and diethanol amine; (2) said mineral oil is a naphthenic oil having a viscosity of about 100 SUS at 100° F.; (3) said polyglycol is the butyl ether of poly (oxyethyleneoxy-1,2-propylene) glycol having an average molecular weight of about 1500, and (4) said glycol is dipropylene glycol.

6. The fluid of claim 4 in which (1) said emulsifier is the condensation product of substantially molar equivalents of oleic acid and diethanol amine; (2) said mineral oil is a naphthenic oil having a viscosity of about 200 SUS at 100° F.; (3) said polyglycol is polypropylene glycol having an average molecular weight of about 450, and (4) said glycol is ethylene glycol.

* * * * *